US009510649B1

(12) United States Patent
Liu et al.

(10) Patent No.: US 9,510,649 B1
(45) Date of Patent: Dec. 6, 2016

(54) USING A SNAP BUTTON TO MAKE DISCONNECTABLE CONNECTION OF ELECTRONIC DEVICES TO FABRICS

(71) Applicant: Flextronics AP, LLC, San Jose, CA (US)

(72) Inventors: Weifeng Liu, Dublin, CA (US); Murad Kurwa, San Jose, CA (US); Anwar Mohammed, San Jose, CA (US); Zhen Feng, San Jose, CA (US)

(73) Assignee: Flextronics AP, LLC, San Jose, CA (US)

( * ) Notice: Subject to any disclaimer, the term of this patent is extended or adjusted under 35 U.S.C. 154(b) by 0 days.

(21) Appl. No.: 14/803,788

(22) Filed: Jul. 20, 2015

(51) Int. Cl.
*H01R 33/00* (2006.01)
*A44B 17/00* (2006.01)
*H01R 43/16* (2006.01)

(52) U.S. Cl.
CPC ..... *A44B 17/0064* (2013.01); *A44B 17/0005* (2013.01); *A44B 17/0041* (2013.01); *H01R 43/16* (2013.01)

(58) Field of Classification Search
CPC .... A41D 1/002; H05K 7/1023; H05K 3/368; H01R 23/725; H01R 12/57; H01R 23/7073
USPC ..... 439/37, 73–75, 83, 660
See application file for complete search history.

(56) References Cited

U.S. PATENT DOCUMENTS 1,691,472 A * 11/1928 Graham ..... A41D 13/0051 2/159
2,342,744 A * 2/1944 McCready ..... H05B 3/342 2/85
4,762,497 A * 8/1988 Burvee ..... H01R 4/64 439/179
5,169,322 A * 12/1992 Frantz ..... H01R 12/716 439/378
5,709,574 A * 1/1998 Bianca ..... H01R 12/57 439/83
6,319,015 B1 * 11/2001 Faunce ..... H01R 11/22 24/662
6,561,814 B2 * 5/2003 Tilbury ..... A41D 27/205 2/102
7,172,433 B2 * 2/2007 Tsai ..... H01R 12/716 439/660
7,344,379 B2 * 3/2008 Marmaropoulos H01R 13/6205 439/37
8,157,570 B2 * 4/2012 Chen ..... H01R 24/38 219/211
8,465,328 B2 * 6/2013 Iida ..... H01R 4/58 439/660
8,998,624 B2 * 4/2015 Ida ..... H01R 13/40 439/74
9,240,642 B2 * 1/2016 Sagayama ..... H01R 12/78

* cited by examiner

*Primary Examiner* — Thanh Tam Le
(74) *Attorney, Agent, or Firm* — Volpe and Koenig, P.C.

(57) ABSTRACT

A disconnectable snap button connection for connecting electronic devices to fabrics, the disconnectable snap button connection and a method for making the same is described herein. The disconnectable snap button connection includes a component, a piece of conductive material, a piece of non-conductive material; wherein the piece of conductive material is attached to the piece of non-conductive material, a male portion of the disconnectable snap button, wherein the male portion of the disconnectable snap button is attached to the component, and a female portion of the disconnectable snap button, wherein the female portion of the disconnectable snap button is attached to the piece of conductive material. When the male portion of the disconnectable snap button is inserted into the female portion of the disconnectable snap button, a connection is made between the component and the piece of conductive material.

20 Claims, 3 Drawing Sheets

USING A SNAP BUTTON TO MAKE DISCONNECTABLE CONNECTION OF ELECTRONIC DEVICES TO FABRICS

FIELD OF INVENTION

Embodiments of the present disclosure generally relate to an electronic module assembled to a conductive fabric, and a method of assembling an electronic module to a conductive fabric.

BACKGROUND

In some applications, it may be desirable to form an assembly of an electronic module on a conductive fabric to form an integrated system. Conventional assemblies include modules stitched to a conductive fabric using conductive wire. The permanent mounting of a component makes it difficult to replace or upgrade. Additionally, permanent mounting of the component makes it difficult to remove when needed, for example, when the clothing needs to be washed.

Accordingly, a need exists for a convenient disconnectable connection of electronic devices to fabrics.

SUMMARY

A disconnectable snap button connection for connecting electronic devices to fabrics, the disconnectable snap button connection and a method for making the same is described herein. The disconnectable snap button connection includes a component, a piece of conductive material, a piece of non-conductive material; wherein the piece of conductive material is attached to the piece of non-conductive material, a male portion of the disconnectable snap button, wherein the male portion of the disconnectable snap button is attached to the component, and a female portion of the disconnectable snap button, wherein the female portion of the disconnectable snap button is attached to the piece of conductive material. When the male portion of the disconnectable snap button is inserted into the female portion of the disconnectable snap button, a connection is made between the component and the piece of conductive material.

BRIEF DESCRIPTION OF THE DRAWING(S)

DETAILED DESCRIPTION OF THE PREFERRED EMBODIMENT(S)

A method for connecting different electronic component/board modules on fabrics to become an integrated system is described herein. The connection is disconnectable, meaning that the components/boards/module can be detached from the fabric. This may be necessary when, for example, bad parts need to be replaced, an upgrade is needed, the device is not needed, the fabric needs to be washed, and the like. A battery may be conveniently mounted on the fabric with a snap button. A sensor, for example, a medical sensor (i.e., a heartbeat sensor, a pulse rate sensor, and the like) may be mounted on the fabric when needed. Additionally, a Radio Frequency Indication (RFID) may be mounted on the fabric for automotive uses, for example, unlocking a car. Additionally, a processing unit, a memory chip, a battery, or other sensors, for example, a GPS, and the like may be mounted on the fabric.

The terms snap button and disconnectable snap button are used interchangeably. The terms snap button and disconnectable snap button are just an example of a mechanical structure that may be used to snap a component to a piece of fabric, similar to early printed circuit board assemblies that utilized pin components.

Figure 1:
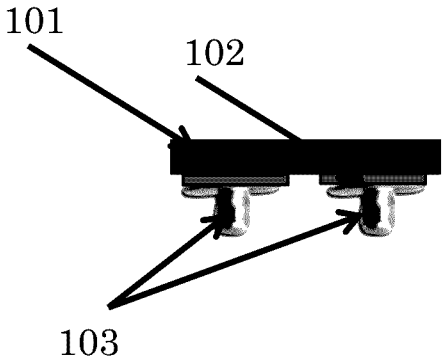
FIG. 1 is an example of a male portion of a snap button attached to a component.

FIG. 1 is an example of a male portion of a snap button attached to a component. In FIG. 1, the component 101, for example a chip, a board, or a module, may have the male portion of the snap button 103 attached to the component 101. The male portion of the snap button 103 may be attached to the component 101 at the terminals or conducting pads 102. The male portion of the snap button 103 may be attached to the component 101 through a surface mount process. For example, the surface mount process may use a reflow process to either solder or weld the male portion of the snap button 103 to the terminals 102 of the component 101.

Figure 2:
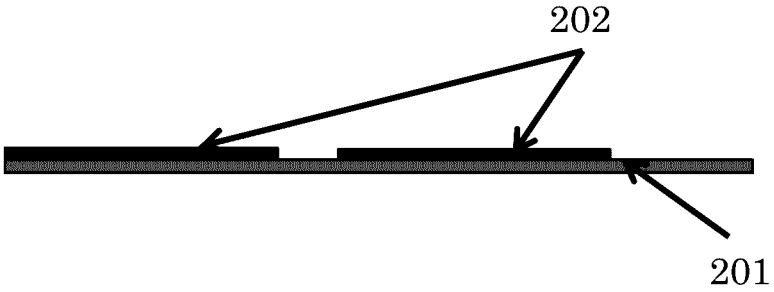
FIG. 2 is an example of the conductive fabric attached to the non-conductive fabric.

FIG. 2 is an example of the conductive fabric attached to the non-conductive fabric. The conductive fabric 202 is attached to the non-conductive fabric 201. The conductive fabric 202 may be stitched or glued to the non-conductive fabric 201. The conductive fabric 202 may be, for example, made of silver plated yarn. The conductive fabric 202 may also, for example, be metal wires that are stitched into the non-conductive fabric 201 or a metal braid sewed to the non-conductive fabric 201. Additionally, the conductive fabric 202 may be a fabric circuit, for example, using plating and etching.

Figure 3:
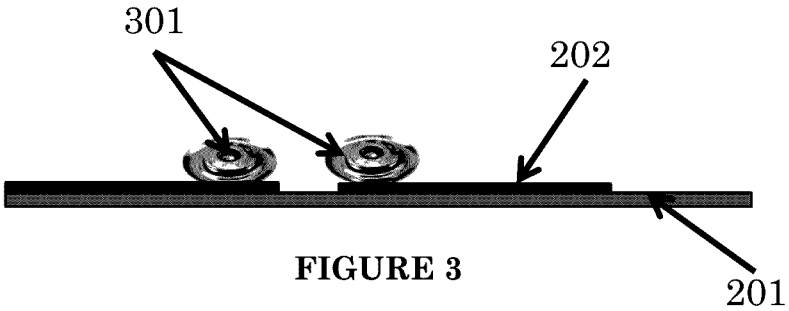
FIG. 3 is an example of a female portion of the snap buttons attached to the conductive fabric.

FIG. 3 is an example of a female portion of the snap buttons attached to the conductive fabric. The female portion of the snap buttons 301 is attached to the conductive fabric 202. The female portion of the snap buttons 301 may be attached to the conductive fabric 202 using a metal fastener process, for example, soldering or welding, or using a sewing process.

Figure 4:
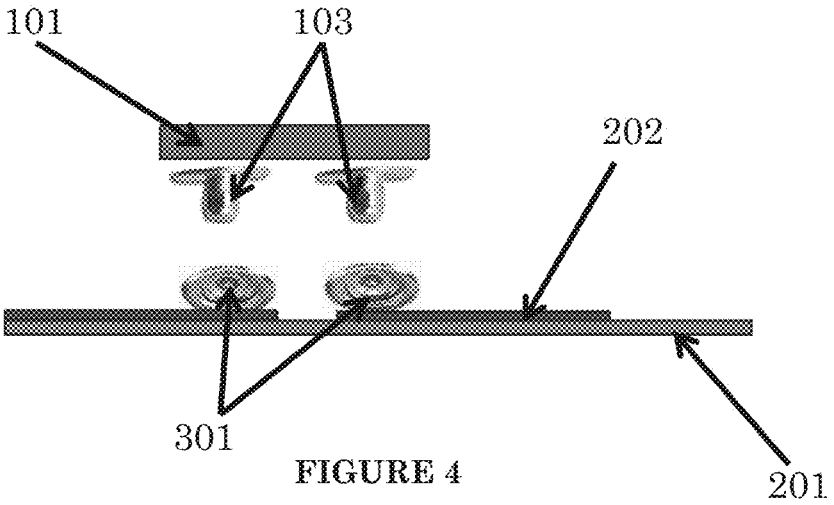
FIG. 4 is an example of the component clamping to the fabric.

FIG. 4 is an example of the component clamping to the fabric. Once the snap button parts, both the female 301 and the male 103 portions of the snap button, are mounted on the conductive fabric 202 and the component 101, respectively, the component 101 may be attached to the fabric 201 by inserting the male portions of the snap button 103 into the female portions of the snap buttons 301.

The button, for example, a receptacle or pin, may be sewn, welded, or soldered to the conducting elements of the fabric. The button may be sewn, welded, or soldered to the conducting pads of the components. For example, the components may be a board, a chip, or a module. The button may be mounted to the component through a surface mount process or on a condition that the button is soldered, it may be inserted into the holes of the board, for example through a hole type. On a condition that the button is sewed into the board, the holes may be needed on the board to allow for sewing.

Figure 5:
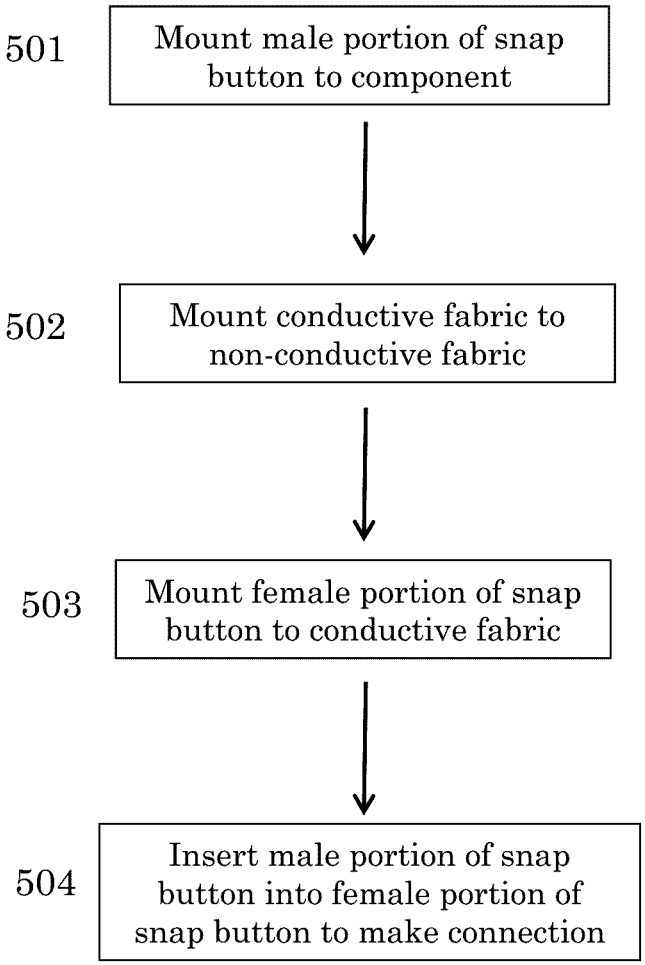
FIG. 5 is an example method of connecting a component to fabric for a disconnectable connection.

FIG. 5 is an example method of connecting a component to fabric for a disconnectable connection. A male portion of a snap button is mounted to a component 501. A conductive fabric mounted to a non-conductive fabric 502. The female portion of the snap button is mounted to the conductive fabric 503. The male portion of the snap button is inserted into the female portion of the snap button to connect the component to the fabric 504. The connection is disconnectable because the snap can be undone and the component can be removed from the fabric.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A disconnectable snap button connection for connecting electronic devices to fabrics, the disconnectable snap button connection comprising:

a component;

a piece of conductive material, wherein the piece of conductive material is a conductive fabric;

a piece of non-conductive material, wherein the piece of conductive material is attached to the piece of non-conductive material;

a male portion of the disconnectable snap button, wherein the male portion of the disconnectable snap button is mounted on an outer surface and attached to the component; and a female portion of the disconnectable snap button, wherein the female portion of the disconnectable snap button is mounted on and attached to the piece of conductive material;

wherein the male portion of the disconnectable snap button is inserted into the female portion of the disconnectable snap button to make a connection between the component and the piece of conductive material.

2. The disconnectable snap button connection of claim 1, wherein the component is a chip.

3. The disconnectable snap button connection of claim 1, wherein the component is a sensor for medical use.

4. The disconnectable snap button connection of claim 1, wherein the component is a Radio Frequency Indication (RFID) for automotive use.

5. The disconnectable snap button connection of claim 1, wherein the male portion of the disconnectable snap button is soldered onto the component.

6. The disconnectable snap button connection of claim 1, wherein the male portion of the disconnectable snap button is welded onto the component.

7. The disconnectable snap button connection of claim 1, wherein the female portion of the disconnectable snap button connection is sewn onto the piece of conductive material.

8. The disconnectable snap button connection of claim 1, wherein the piece of conductive material is glued onto the piece of non-conductive material.

9. The disconnectable snap button connection of claim 1, wherein the piece of conductive material is silver cloth.

10. The disconnectable snap button connection of claim 1, wherein the piece of non-conductive material is fabric.

11. A method for making a connection between electronic devices and fabrics using a disconnectable snap button connection, the method comprising:

attaching a male portion of the disconnectable snap button to a component;

attaching a piece of conductive material to a piece of non-conductive material;

attaching a female portion of the disconnectable snap button to the piece of conductive material; and inserting the male portion of the disconnectable snap button into the female portion of the disconnectable snap button to make a connection between the component and the piece of conductive material, wherein the piece of conductive material is made of fabric.

12. The method of claim 11, wherein the component is a chip.

13. The method of claim 11, wherein the component is a sensor for medical use.

14. The method of claim 11, wherein the component is a Radio Frequency Indication (RFID) for automotive use.

15. The method of claim 11, wherein the male portion of the disconnectable snap button is soldered onto the component.

16. The method of claim 11, wherein the male portion of the disconnectable snap button is welded onto the component.

17. The method of claim 11, wherein the female portion of the disconnectable snap button connection is sewn onto the piece of conductive material.

18. The method of claim 11, wherein the piece of conductive material is glued onto the piece of non-conductive material.

19. The method of claim 11, wherein the piece of conductive material is silver cloth.

20. The method of claim 11, wherein the piece of non-conductive material is fabric.

* * * * *